US012623134B2

(12) United States Patent
Yoo et al.

(10) Patent No.: US 12,623,134 B2
(45) Date of Patent: May 12, 2026

(54) SYSTEMS AND METHODS FOR A CONFIGURABLE TRAINING SYSTEM

(71) Applicant: University of Maryland, College Park, College Park, MD (US)

(72) Inventors: Byungseok Yoo, Olney, MD (US); Donovan Pines, Clarksville, MD (US); Russell Canouse, Chantilly, VA (US)

(73) Assignee: University of Maryland, College Park, College Park, MD (US)

( * ) Notice: Subject to any disclaimer, the term of this patent is extended or adjusted under 35 U.S.C. 154(b) by 674 days.

(21) Appl. No.: 17/749,026

(22) Filed: May 19, 2022

(65) Prior Publication Data

US 2022/0370880 A1 Nov. 24, 2022

Related U.S. Application Data

(60) Provisional application No. 63/260,679, filed on Aug. 27, 2021, provisional application No. 63/190,755, (Continued)

(51) Int. Cl.
*A63B 69/00* (2006.01)
*A63B 63/00* (2006.01)
(Continued)

(52) U.S. Cl.
CPC ..... *A63B 71/0619* (2013.01); *A63B 63/00* (2013.01); *A63B 71/03* (2020.08);
(Continued)

(58) Field of Classification Search
CPC ..... A63B 71/0619; A63B 63/00; A63B 71/03; A63B 2063/001; A63B 2220/833; A63B 225/74
(Continued)

(56) References Cited

U.S. PATENT DOCUMENTS 7,951,045 B1 * 5/2011 Brader ..... A63B 71/06 482/3
7,957,583 B2 6/2011 Boca et al.
(Continued)

FOREIGN PATENT DOCUMENTS

EP 2383699 B1 8/2015
GB 2520797 B 6/2017
(Continued)

OTHER PUBLICATIONS

DASO soccer wall, downloaded from https://www.soccersmartwall.com/home, on Oct. 5, 2022, 3 pages.
(Continued)

*Primary Examiner* — Mitra Aryanpour
(74) *Attorney, Agent, or Firm* — Quarles & Brady LLP; Yakov S. Sidorin

(57) ABSTRACT

Systems, methods, and media for a configurable training system are provided. The configurable training system can include a controller and one or more configurable training devices. The configurable training device can include a housing, a cover coupled to a front surface of the housing, a sensor located within the housing to detect an impact, an indicator located within the housing and configured to emit light, and communication circuitry coupled with the indicator and the sensor. The communication circuitry may be coupled with the controller. The configurable training system may be adapted to various athletic training equipment or other equipment for physical activity.

20 Claims, 9 Drawing Sheets

Related U.S. Application Data filed on May 19, 2021, provisional application No. 63/190,760, filed on May 19, 2021.

(51) Int. Cl.
*A63B 71/02* (2006.01)
*A63B 71/06* (2006.01)

(52) U.S. Cl.
CPC ..... *A63B 2063/001* (2013.01); *A63B 2220/05* (2013.01); *A63B 2220/30* (2013.01); *A63B 2220/53* (2013.01); *A63B 2220/62* (2013.01); *A63B 2220/807* (2013.01); *A63B 2220/833* (2013.01); *A63B 2225/74* (2020.08)

(58) Field of Classification Search
USPC ..... 473/422, 446
See application file for complete search history.

(56) References Cited

U.S. PATENT DOCUMENTS

| | | | | |
|---|---|---|---|---|
| 8,109,845 | B2 * | 2/2012 | Duty | A63B 63/004 473/478 |
| 9,162,127 | B2 | 10/2015 | Holland et al. | |
| 9,292,734 | B2 | 3/2016 | Zhu et al. | |
| 9,791,246 | B2 * | 10/2017 | D'Andrade | A63B 24/0087 473/446 |
| 9,889,361 | B2 * | 2/2018 | Noll | F41J 5/20 473/446 |
| 9,987,541 | B2 * | 6/2018 | Traustason | A63B 69/00 |
| 2008/0152191 | A1 | 6/2008 | Fujimura et al. | |
| 2013/0066588 | A1 * | 3/2013 | Sherry | G09B 19/0038 702/150 |
| 2013/0266182 | A1 | 10/2013 | Shotton et al. | |
| 2015/0283443 | A1 | 10/2015 | Dunser | |
| 2017/0113114 | A1 | 4/2017 | Nugent | |
| 2019/0366179 | A1 | 12/2019 | Holland et al. | |
| 2022/0203221 | A1 | 6/2022 | Dobney | |
| 2023/0157582 | A1 | 5/2023 | Saekel | |

FOREIGN PATENT DOCUMENTS

| | | | |
|---|---|---|---|
| GB | 2589842 | A | 6/2021 |
| JP | 2019516535 | A | 6/2019 |
| WO | 2015/110795 | A1 | 7/2015 |
| WO | 2017/025972 | A1 | 2/2017 |
| WO | 2017/199011 | A1 | 11/2017 |
| WO | 2021/255717 | A1 | 12/2021 |

OTHER PUBLICATIONS

Elite Skills Arena (ESA), downloaded from https://www.eliteskillsarena.com/products, on Oct. 5, 2022, 5 pages.
Goal Station (GS), downloaded from https://goalstation.com/, on Oct. 5, 2022, 8 pages.
Toshev e al., "Deeppose: Human pose estimation via deep neural networks." Proceedings of the IEEE conference on computer vision and pattern recognition. 2014. 4 pages.
Martinez et al. "A simple yet effective baseline for 3d human pose estimation." Proceedings of the IEEE international conference on computer vision. 2017. p. 2640-9.
A-Champs—"ReboundерPro" downloaded Sep. 7, 2023, from https://a-champs.com/products/rebounderpro, 10 pages.

* cited by examiner

SYSTEMS AND METHODS FOR A CONFIGURABLE TRAINING SYSTEM

CROSS-REFERENCE TO RELATED APPLICATIONS

This application is based on, claims priority to, and incorporates herein by reference in its entirety U.S. Ser. No. 63/190,760 filed May 19, 2021, and entitled "ATHLETIC TRAINING SYSTEM, DEVICE, AND METHODS OF USING THE SAME," U.S. Ser. No. 63/190,755 filed May 19, 2021, and entitled "SYSTEM, DEVICES, AND METHODS FOR ATHLETIC DRILL TRAINING," and U.S. Ser. No. 63/260,679 filed Aug. 16, 2021, and entitled "INTERCHANGEABLE SMART SPORTS TRAINING SYSTEM BASED ON SMART CLIP-ON DEVICE."

FIELD

The present disclosure relates generally to smart athletic equipment, and, more particularly, to systems and methods for a training system that can enable flexible and reconfigurable smart athletic training equipment.

BACKGROUND

Many athletes, especially younger athletes, may be unable to afford or travel to appropriate athletic coaches. Smart athletic training equipment allows users to practice or play a sport or other activity in a more isolated manner, for example without a coach or other team members. However, current smart athletic training equipment is expensive and uses fixed sensors and signaling that only enable a small number of drills or games to be performed, in a limited configuration. In order to perform a variety of drills, a user may be required to obtain and store several different smart athletic training devices.

It would be desirable to provide a system and method that enables portable, flexible, and reconfigurable smart athletic training equipment.

SUMMARY

In accordance with some embodiments of the disclosed subject matter, systems, methods, and media for a configurable training system are provided.

In accordance with some embodiments of the disclosed subject matter, a configurable training device is provided, comprising a housing, a cover coupled to a front surface of the housing, a sensor located within the housing, wherein the sensor is configured to detect an impact, an indicator located within the housing, wherein the indicator is configured to emit visible light, and communication circuitry coupled with the indicator and sensor.

In some embodiments, the sensor comprises a piezo sensor.

In some embodiments, the indicator comprises a plurality of LEDs.

In some embodiments, the LEDs are arranged in the shape of a ring.

In some embodiments, the housing is configured to couple with an adaptor.

In some embodiments, the adaptor comprises a cone adaptor.

In some embodiments, the adaptor is configured to couple with a kickback wall.

In some embodiments, the housing comprises an extension configured to accept at least one of a screw or a bolt.

In some embodiments, the adaptor is configured to accept at least one of a screw or a bolt.

In accordance with some embodiments of the disclosed subject matter, a configurable training system is provided, comprising a configurable training device, the configurable training device comprising an indicator and communication circuitry coupled with the indicator, the system further comprising a controller communicatively coupled with the configurable training device via the communication circuitry, wherein the controller is configured to perform a drill sequence.

In some embodiments, the configurable training system comprises a plurality of configurable training devices communicatively coupled with the controller.

In some embodiments, the configurable training system comprises a first direction guide comprising a first configurable training device of the plurality of configurable training devices, and a first target comprising a second configurable training device of the plurality of configurable training devices, wherein the second configurable training device comprises a first impact sensor coupled with the communication circuitry of the second configurable training device.

In some embodiments, the controller is configured to perform the drill sequence using the direction guide and target.

In some embodiments, the impact sensor comprises a piezo sensor.

In some embodiments, the indicator comprises a plurality of LEDs.

In some embodiments, the LEDs are arranged in the shape of a ring.

In some embodiments, the configurable training device is configured to couple with an adaptor.

In some embodiments, the adaptor comprises a cone adaptor.

In some embodiments, the configurable training system.

In some embodiments, the configurable training device comprises a piezo sensor.

In some embodiments, the adaptor is configured to couple with a kickback wall.

In some embodiments, the configurable training system further comprises a second target comprising a third configurable training device of the plurality of configurable training devices, wherein the third configurable training device comprises a second impact sensor coupled with the communication circuitry of the third configurable training device, and wherein the direction guide and first target are configured to couple with a kickback wall and the second target is configured to couple with a cone adaptor.

BRIEF DESCRIPTION OF THE DRAWINGS

The present disclosure will hereafter be described with reference to the accompanying drawings, wherein like reference numerals denote like elements.

DETAILED DESCRIPTION

The present disclosure describes systems and methods for a configurable training system. In particular, novel systems and methods are introduced whereby the configurable training system may comprise configurable training devices that can be reconfigurably-arranged in various training modes or with various athletic training equipment. Advantageously, the configurable training system enables more complex drills, such as combining various modes of training (e.g., cone drills combined with passing practice). Advantageously, the configurable training devices may be sacrificial, such that they are easily replaced if damaged during use. The configurable training system can facilitate user customization of training sequences, for example via an app such as a smartphone app.

Figure 1B:
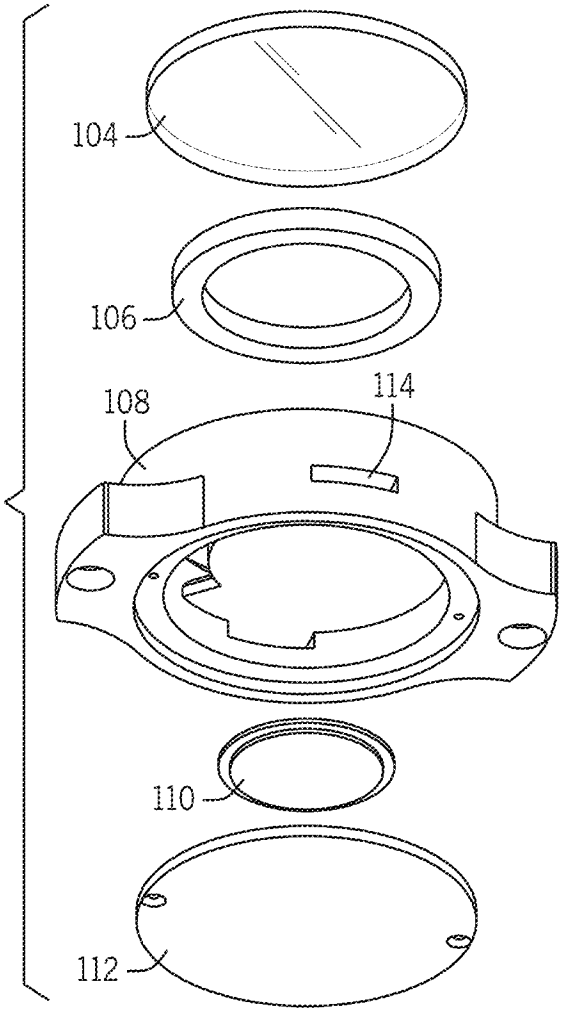
FIG. 1B is an exploded view drawing of an example configurable training device in accordance with an embodiment.
Figure 1A:
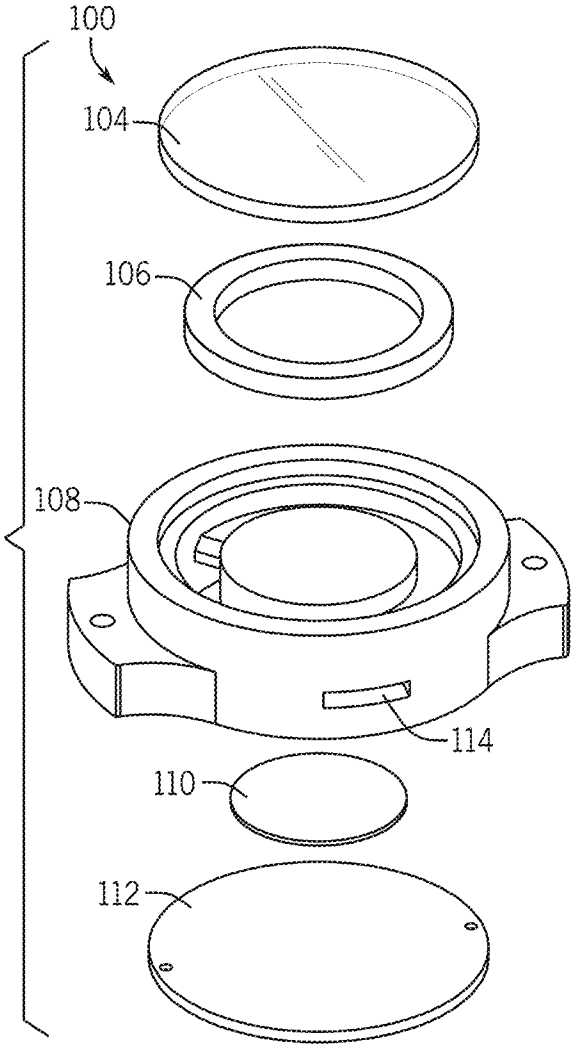
FIG. 1A is an exploded view drawing of an example configurable training device in accordance with an embodiment.

FIGS. 1A and 1B are exploded view drawings of an example configurable training device 100 in accordance with one embodiment of the present disclosure. A configurable training device 100 may include a front cover 104, an indicator 106, a housing 108, a sensor 110, and a back cover 112. The housing 108 may be configured to couple with the front cover 104, for example at a front surface of the housing 108. The housing 108 may be further configured to couple with the back cover 112, for example at a back surface of the housing 108 opposite the front surface of the housing 108. In some embodiments, the housing may comprise the back cover 112. In some embodiments, the housing may be coupled with the front cover 104 and back cover 112, the indicator 106 may be located between the housing 108 and front cover 104, and the sensor 110 may be located between the housing 108 and the back cover 112. The housing 108 and/or back cover 112 may be made from any suitable material, such as plastic, metal, and the like. The housing 108 and/or back cover 112 may be made using any suitable system or method, such as 3D printing, injection molding, casting, and the like.

In some embodiments, the configurable training device 100 may comprise communication circuitry coupled to, and configured to allow communication to and/or from, the sensor 110 and/or indicator 106. In some embodiments, the communication circuitry may be configured to provide wireless communication, such as a wireless transceiver (e.g., WiFi, Bluetooth, etc.). In some embodiments, the communication circuitry may be configured to provide wired communication, such as via electrical wires. In some embodiments, the electrical wires may be coupled directly to the sensor 110 and/or indicator 106. In some embodiments, the electrical wires may be indirectly coupled with the sensor 110 and/or indicator 106, for example via an Ethernet transceiver. In some embodiments, the housing 108 may comprise an opening 114 configured to allow one or more electrical wires to pass through the housing 108. In some embodiments, the housing 108, front cover 104, back cover 112, and in some examples the opening 114, may be configured to facilitate a waterproof internal cavity when coupled. The various components of the training device 100 may be coupled using any suitable (or combination of suitable) systems or methods, such as glue, epoxy, fasteners (e.g., screws, rivets, etc.), welds, tape, and the like.

The front cover 104 may be configured to withstand repeated impacts and protect the indicator 106 and/or sensor 110, and may comprise any suitable material. In some embodiments, the front cover 104 may comprise a non-opaque or partially-opaque material, for example glass, plastic, acrylic, and the like. The front cover 104 may be configured (e.g., combination of material, dimensions, and design) to withstand repeated impacts by an object, such as a human body part (hand, foot, etc.), sporting implement (e.g., a soccer ball, hockey puck, hockey stick, basketball, etc.), and the like. In some embodiments, withstanding impact may comprise continuing to protect the indicator 106 and/or sensor 110 or any other internal components of the housing.

The indicator 106 may comprise any suitable device or combination of devices capable of signaling, or otherwise conveying information to, a person. In some embodiments, the indicator 106 may comprise a light (e.g., one or more LEDs) and/or a display (e.g., a two-dimensional display such as an LCD, OLED, etc.), and may be configured in any suitable arrangement such as a single light, a pattern of lights, a ring of lights, a mini OLED, and the like. In some embodiments, the indicator 106 may comprise a plurality of addressable and/or color-selectable LEDs. In an exemplary embodiment, the indicator 106 comprises a ring of addressable and/or color-selectable LEDs. In some embodiments, the indicator 106 may comprise a speaker to provide an audio signal (e.g., a beep, siren, music, verbal indication, etc.).

The sensor 110 may comprise any suitable sensor for detecting an impact and/or detecting object distance or location. In some embodiments, the sensor 110 may be configured to detect an energy wave caused by the impact (referred to herein as an "impact wave"). In some embodiments, the sensor 110 may comprise a vibration sensor, such as a piezo vibration sensor, strain gauge, touch sensor, accelerometer, gyroscope, a suitable MEMS device, and the like. In some embodiments, the sensor 110 may comprise an electromagnetic or sonic sensor, such as radar or sonar sensors. In some exemplary embodiments, the configurable training device 100 comprises an indicator 106 but no sensor 110. In some other exemplary embodiments, the configurable training device 100 comprises a sensor 110 but no indicator 106.

In an exemplary embodiment according to FIG. 1, the sensor 110 comprises a piezo vibration sensor. Advantageously, piezo sensors have a suitable and wide frequency response bandwidth, high sensitivity, high signal-to-noise ratio, and relatively simple structure. Piezo sensors are also rugged, reliable, simple to operate, and lightweight.

Figure 1C:
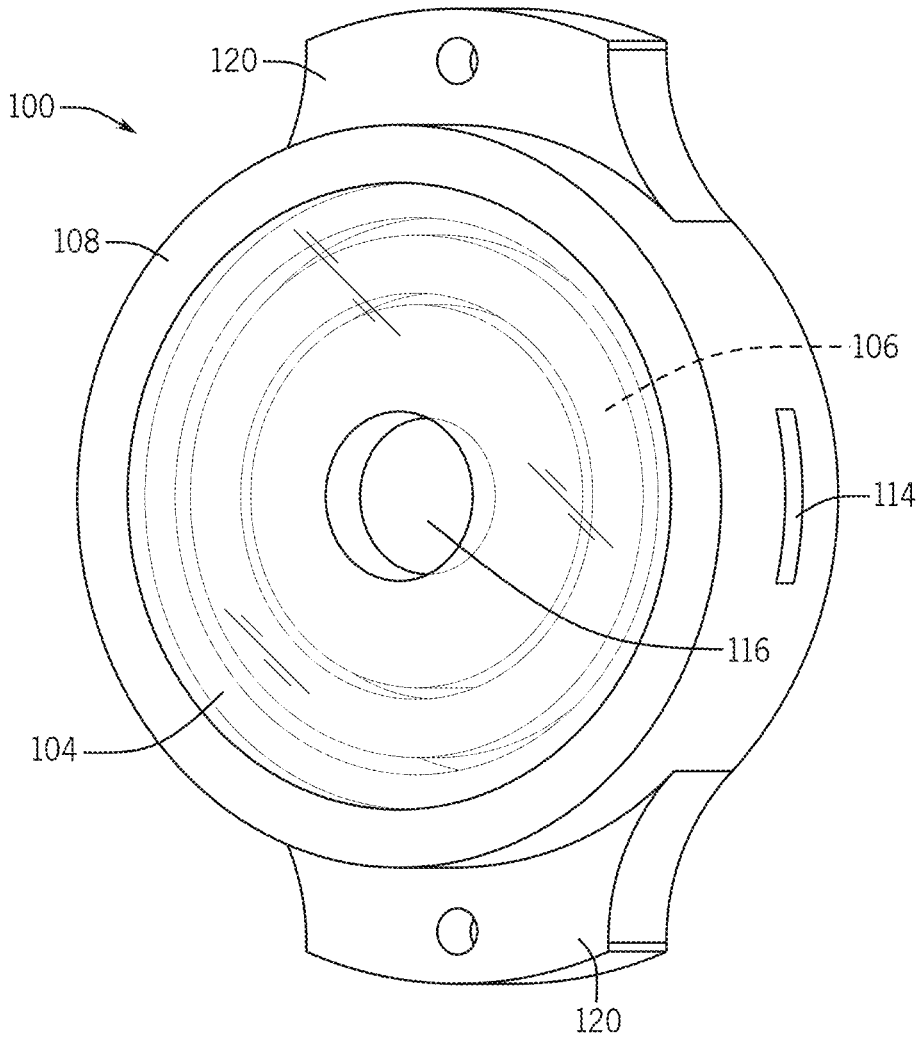
FIG. 1C illustrates an example configurable training device in accordance with an embodiment.

Referring to FIG. 1C, in some embodiments the configurable training device 100 may comprise a camera 116. In some embodiments, the camera 116 may be contained internal to the training device 100. The camera may be configured to convert a received image of a scene to electrical signals and to transmit or store such electrical signals in an image format. In some embodiments, the camera 116 may facilitate tracking of the position of a human body and/or tracking of a sporting implement (e.g., motion capture). In some embodiments, the camera 116 may be configured to observe depth information of a scene, such as with a time-of-flight image sensor, stereo image sensors, and the like. In some embodiments, the camera 116 may be placed adjacent to (and in some embodiments, in direct contact with) the front cover 104. In some embodiments, the camera 116 may be placed within the indicator 106, such as when the indicator 106 comprises a ring of LEDs.

Figure 2A:
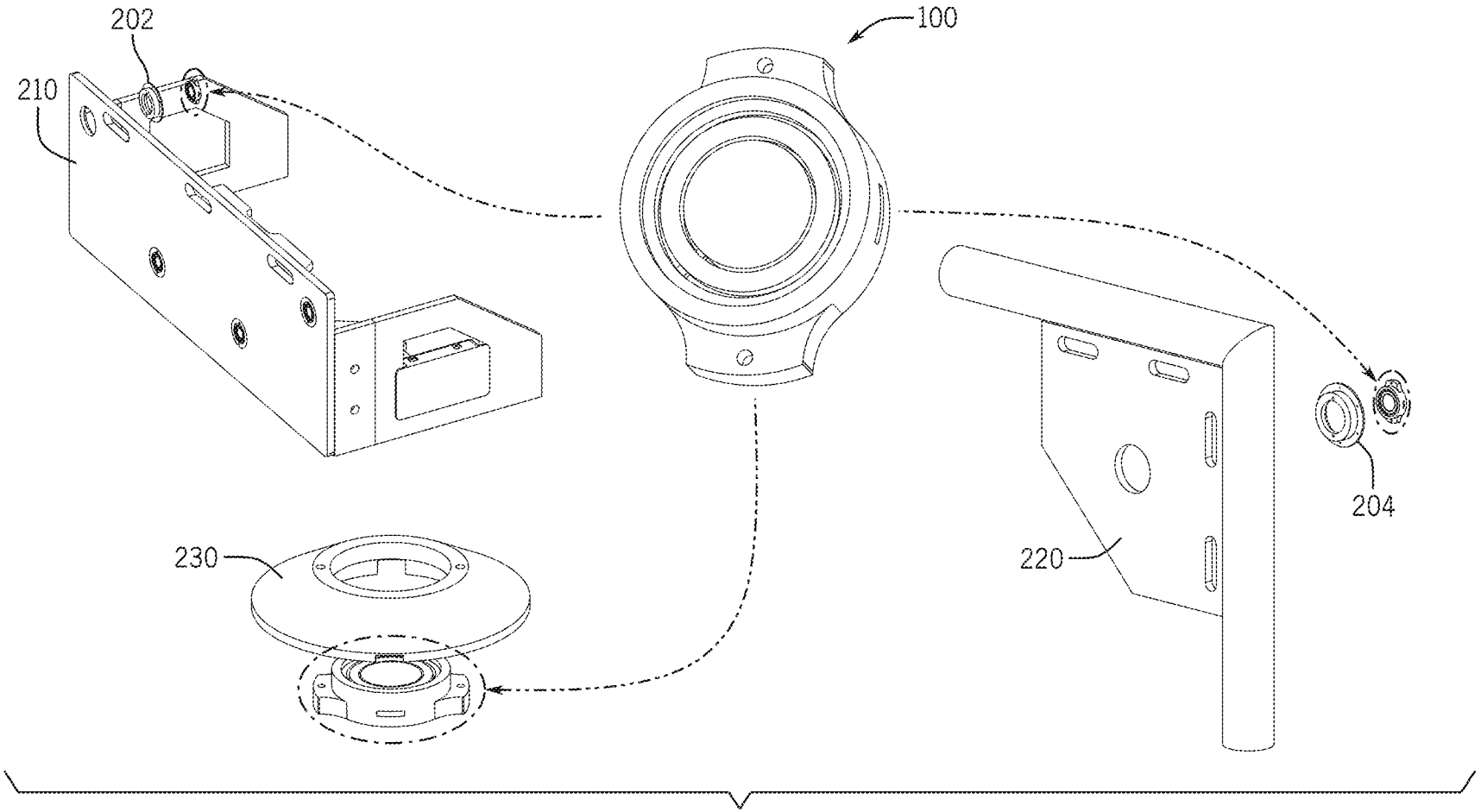
FIG. 2A illustrates example configurations of a configurable training device in accordance with several embodiments.

Referring to FIG. 2A, the configurable training device 100 may be configured to, permanently or impermanently, physically couple with one or more adaptors 202, 204, 230. In some embodiments, the adaptors 202, 204 may be configured to, permanently or impermanently, couple the configurable training device 100 to an object, for example athletic equipment or game equipment. In some embodiments, the adaptors 202, 204, 230 may facilitate adaptation of the configurable training device 100 for use with one or more athletic training equipment. The athletic training equipment may comprise any suitable apparatus configured to facilitate athletic training for a sport or game, such as basketball, football, lacrosse, hockey, soccer, tennis, spikeball, cornhole, frisbee, horseshoe, or the like. The athletic training equipment may comprise, for example, a soccer rebounder net, a goal shooting target 220 (e.g., a target attachable to a hockey goal, soccer goal, basketball backboard, etc.), a soccer kickback wall 210, and the like. In some embodiments, the adaptors may facilitate adaptation of the configurable training device 100 for use with one or more recreational games, such as cornhole, frisbee, horseshoes, spikeball, and the like.

In some embodiments, the adaptor 230 may be configured as athletic training equipment, for example a cone such as a drill cone. In some embodiments, the configurable training device 100 may be configured to couple with an adaptor such as a clip, hook-and-loop strap, and the like, for coupling with nets, walls, other athletic training equipment, and the like. In some such embodiments, the back cover 112 may be configured to couple with one or more such adaptors. The present technology is not limited to the adaptors exemplified herein.

The configurable training device 100 may physically couple with the adaptors 202, 204, 230 using any suitable system or method. For example, the configurable training device 100 may couple to adaptors 202, 204, 230 using screws, bolts, friction fit, twist-lock mechanism, glue, tape, and the like. Briefly referring to FIG. 1C, in some embodiments, the configurable training device 100 may comprise extensions 120, for example extensions of the housing 108, having holes configured to accept screws and/or bolts (e.g., with or without threads). In some embodiments, the adaptors 202, 204, 230 may be configured to accept screws and/or bolts (e.g., with or without threads). In some embodiments, the extensions 120 may be configured to engage with a twist-lock mechanism or press fit.

Figure 2B:
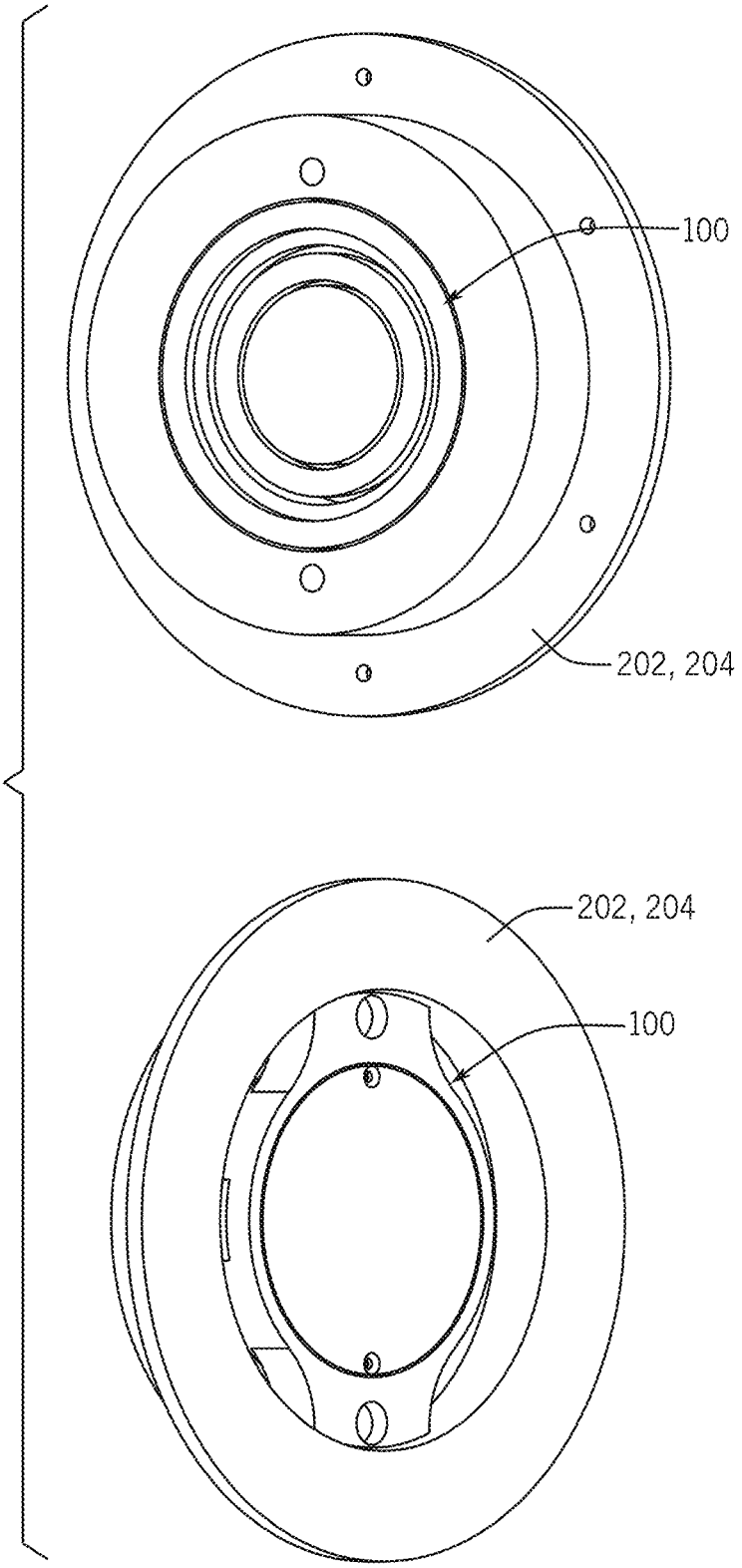
FIG. 2B illustrates an example adaptor for a configurable training device in accordance with an embodiment.

Referring to FIG. 2B, the adaptors 202, 204 may be configured to physically couple with any suitable athletic training equipment, such as a goal shooting target 220 or soccer a kickball wall 210, using any suitable system or method. For example, the adaptor 202, 204 may couple to the athletic training equipment using screws, bolts, friction fit, twist-lock mechanism, glue, tape, and the like. The adaptors may comprise any suitable material, for example as plastic or metal, and may be made using any suitable system or method, for example, 3D printing or injection molding. In some embodiments, the adaptor may be a semi-universal adaptor, configured to adapt the configurable training device 100 to a variety of athletic training equipment. In an exemplary embodiment, the adaptors 202, 204 comprise the same adaptor.

Figure 3A:
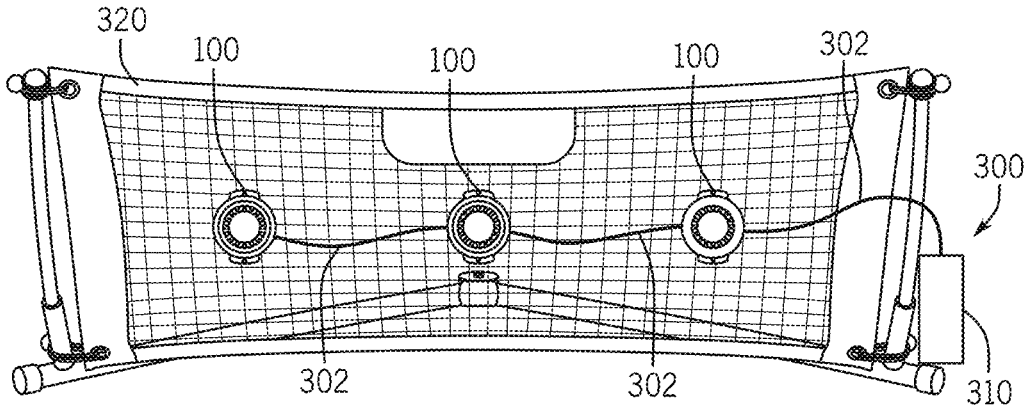
FIG. 3A illustrates an example configurable training system in accordance with a first embodiment.

Referring to FIG. 3A, a configurable training system 300 may comprise a controller 310 configured to communicatively couple with one or more configurable training devices 100. Each configurable training device 100 may communicatively couple directly with the controller 310, and/or may indirectly couple with the controller 310, for example through a second configurable training device 100 (wherein the second configurable training device 100 may allow the communication to pass through, may relay the communication, or the like).

The controller 310 may communicate with one or more configurable training devices 100 using any suitable system or method, for example using wired or wireless communication. Communication between the controller 310 and one or more configurable training devices 100 may comprise transfer of sensor 110 data to the controller 310, instructions or control to the configurable training devices relating to the indicators 106, or the like. In some embodiments, sensor 110 data may be processed within a configurable training device and/or may be processed by the controller 310.

In some embodiments, the configurable training system 300 further comprises one or more electrical wires 302 coupled between the controller 310 and one or more configurable training devices 100, the electrical wires 302 facilitating communication between the controller 310 and the one or more configurable training devices 100. The electrical wires 302 may comprise, for example, coaxial cable, an Ethernet cable (e.g., a Cat 6 Ethernet cable), or the like. In some embodiments, the controller 310 may be communicatively coupled with one or more configurable training devices 100 using wireless communication such as Wi-Fi®, Bluetooth®, Zigbee®, Z-Wave®, or the like.

Communication may be one-way between the controller 310 and one or more configurable training devices 100 (with controller 310 as sender or receiver), may be two-way between the controller 310 and each configurable training device 100, or may be multi-way between the various components of the configurable training system 300. The configurable training system 300 may use any suitable network topology for communication between the controller 310 and the one or more configurable training devices 100, for example point-to-point, star, daisy chain, mesh, tree, hybrid, or the like. In some exemplary embodiments, the configurable training system 300 uses a daisy chain topology. In some exemplary embodiments, the configurable training system 300 uses a star topology. In some embodiments, a configurable training device 100 may be configured to communicate with other configurable training devices 100 of the configurable training system 300.

Figure 3B:
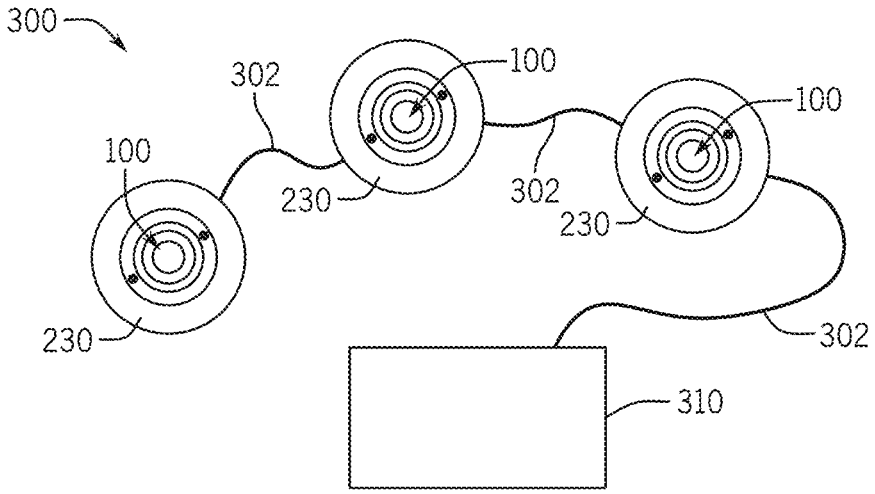
FIG. 3B illustrates an example configurable training system in accordance with a second embodiment.

Referring again to FIG. 3A, the configurable training system 300 may be deployed with athletic training equipment, for example a soccer rebounder net 320. In this exemplary embodiment, the adaptors may comprise a clip, hook-and-loop strap, or the like, configured to couple one or more configurable training devices 100 to the soccer rebounder net 320. Referring to FIG. 3B, in some embodiments, the configurable training system 300 may be deployed as drill cone athletic training equipment. In such exemplary embodiments, the adaptors may comprise a drill cone 230. In some embodiments, the configurable training system 300 may be deployed in a combination of configurations, for example in a combination goal shooting target 220 and drill cone 230 configuration.

Figure 4A:
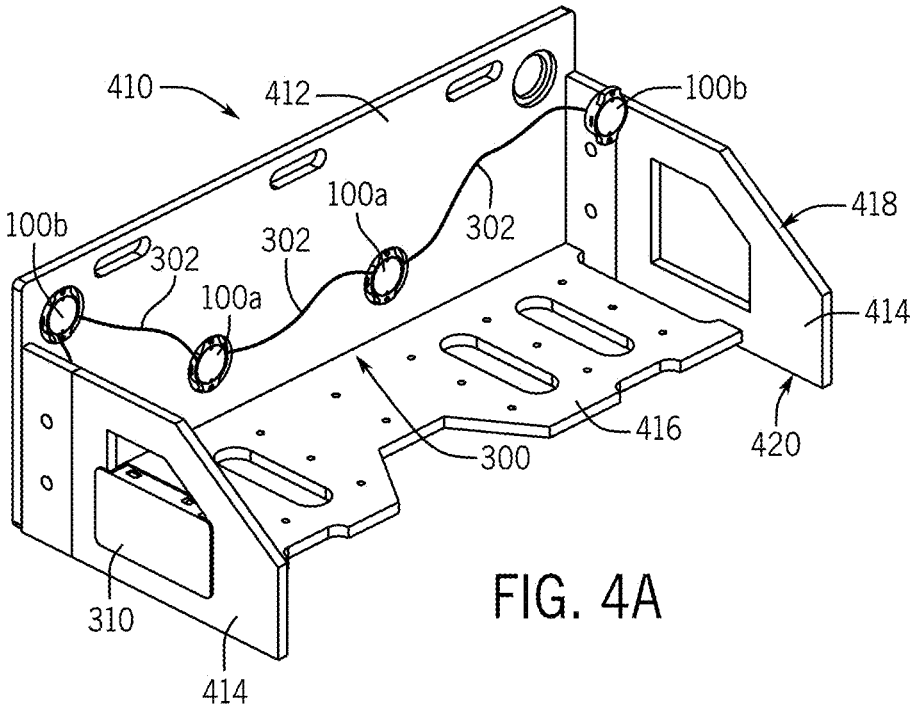
FIG. 4A illustrates an example configurable training system with an example kickback wall in accordance with a third embodiment.
Figure 4B:
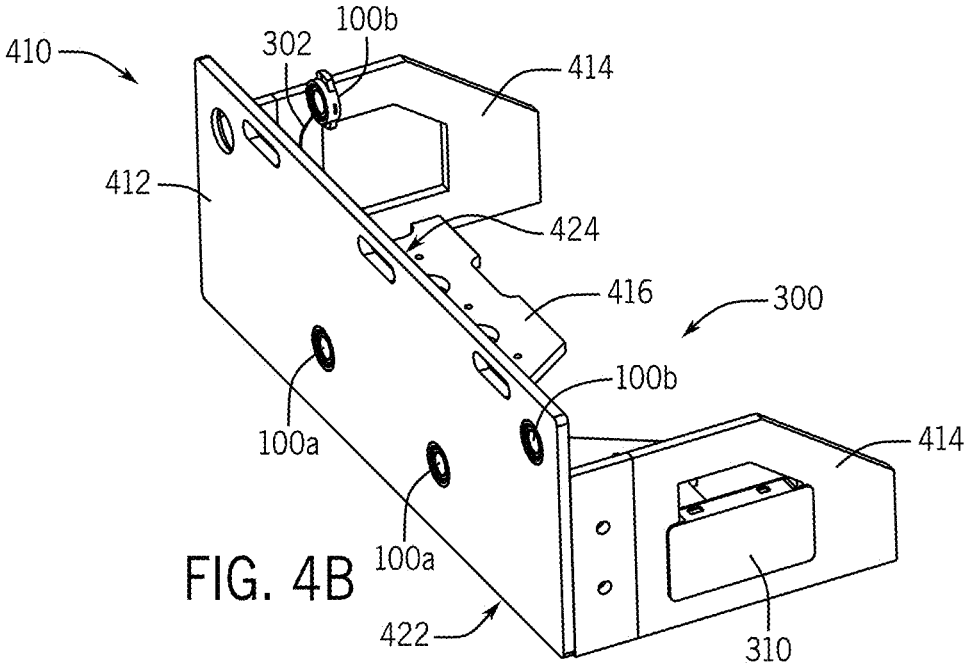
FIG. 4B illustrates an example configurable training system with an example kickback wall in accordance with a third embodiment.

Referring to FIGS. 4A and 4B, the configurable training system 300 may be deployed with athletic training equipment, for example a kickback wall 410. In some embodiments, the kickback wall 410 may comprise a front plate 412 and one or more support legs 414. In an exemplary embodiment, the configurable training system 300 may comprise a plurality of configurable training devices 100*a* having an indicator 106 and sensor 110, a plurality of configurable training devices 100*b* having an indicator 106 but no sensor 110, and a controller 310. Configurable training devices 100*a* may be used to indicate to a user a target to impact with an athletic implement (e.g., where to kick a soccer ball) and to sense such impact, and configurable training devices 100*b* may be used to provide other indication to the user, such as a choice of body position, body movement, body side to use (e.g., left foot or right foot), or the like. The controller may communicate with the plurality of configurable training devices 100*a*, 100*b* via electrical wires 302, or alternatively wirelessly.

In some embodiments, the front plate 412 may be configured to directly accept the one or more configurable training devices 100*a*, 100*b*. In some embodiments, the one or more configurable training devices 100*a*, 100*b* may be coupled with the front plate 412 via an adaptor, as previously described. In some embodiments, the controller 310 may be coupled to the kickback wall 410, for example, to the front plate 412 or support leg 414.

In some embodiments, the front plate 412 may be configured to rebound an athletic implement, such as a soccer ball, upon impact of the athletic implement. The one or more support legs 414 may be configured to provide support to the front plate 412 and to maintain it in a particular orientation (e.g., at a particular angle with respect to the surface upon which the kickback wall is placed). In some embodiments, the one or more support legs 414 may be permanently or impermanently attached to the front plate 412 using any suitable system or method. In some embodiments, the one or more support legs 414 may be foldably-attached to the front plate 412, for example by one or more hinges.

In some embodiments, the one or more support legs 414 may comprise a first edge 418 and a second edge 420 opposite the first edge 418, each having a different angle with respect to the front plate 412. In some such exemplary embodiments, the leg may be attachable to the front plate 412 in a first orientation with the first edge 418 facing the surface upon which the kickback wall 410 is placed, and in a second orientation with the second edge 420 facing the surface upon which the kickback wall is placed. In this manner, the front plate 412 may be oriented in multiple angles with respect to such surface. In some other embodiments, the entire kickback wall 410 may be placed with the first edge 418 or second edge 420 facing the surface, to provide multiple angles of the front plate 412 with respect to such surface.

In some embodiments, the kickback wall 410 may comprise a friction plate 416. In some embodiments, the friction plate 416 may be permanently or impermanently attached to the front plate 412 and/or the one or more support legs 414 using any suitable system or method. In some embodiments, the friction plate 416 may be foldably-attached to the front plate 412, for example by one or more hinges. In some embodiments, the friction plate 416, front plate 412, and/or support legs 414 may be configured to allow attachment of the friction plate to the kickback wall 410 proximate to the support leg edge 418, 420 that adjacent to the surface upon which the kickback wall 410 is placed. For example, the friction plate 416 may be attachable to the front plate 412 proximate to a first edge 422 of the front plate 412 and a second edge 424 of the front plate 412.

The various components of the kickback wall 410 may be made from any suitable material or combination of materials. In some embodiments, the front plate 412, support legs 414, and friction plate 416 may comprise metal, plastic (e.g., HDPE), or the like. In some embodiments, the friction plate 416 may comprise a material that, when contacting the surface on which the kickback wall 410 is placed, prevents substantial movement of the kickback wall 410 when impacted by an athletic implement, wherein such substantial movement would distinctly interfere with the athletic activity. In some embodiments, the friction plate 416 may comprise a surface having a rough/sandpaper-like surface, spikes/cleats, rubber, or the like.

In terms of materials that may be utilized for the kickback wall 410, in some embodiments it may be desirable to match the physical properties of the kickback wall to the types of sensors, sensor housings, and uses of the kickback wall. For example, where the kickback 410 wall will be integrated with piezo-electric sensors (which detect vibration through wave propagation in the wall), a specific type of material may be more helpful. In such embodiments, the ball impact wave propagation through the kickback wall is closely related to the material properties of the wall. Therefore, in some embodiments, the kickback wall material can be made of one or more isotropic and homogeneous materials, such as metals and high-density plastics so that the ball impact wave can propagate effectively through the kick wall without significant loss of the wave energy and can be detected by the piezo sensors mounted to the wall (e.g., directly or via configurable training device(s) 100). In these circumstances, where wave propagation is to be detected, the kickback wall can be constructed such that the sensors are inset with respect to the front (player-facing) plane of the kickback wall 410. In these embodiments, the sensors are saved from direct impact of a ball, but can still detect wave propagation through the kickback wall 410. In other embodiments, where sensors comprise accelerometers or deformable/movable force plates, which may be more suitable for experiencing direct impacts of a ball, the sensors need not be inset and the material of the kickback wall may be isotropic and homogeneous, a more non-homogeneous material (such as plywood or other fibrous materials), or a mixture thereof.

Figure 5:
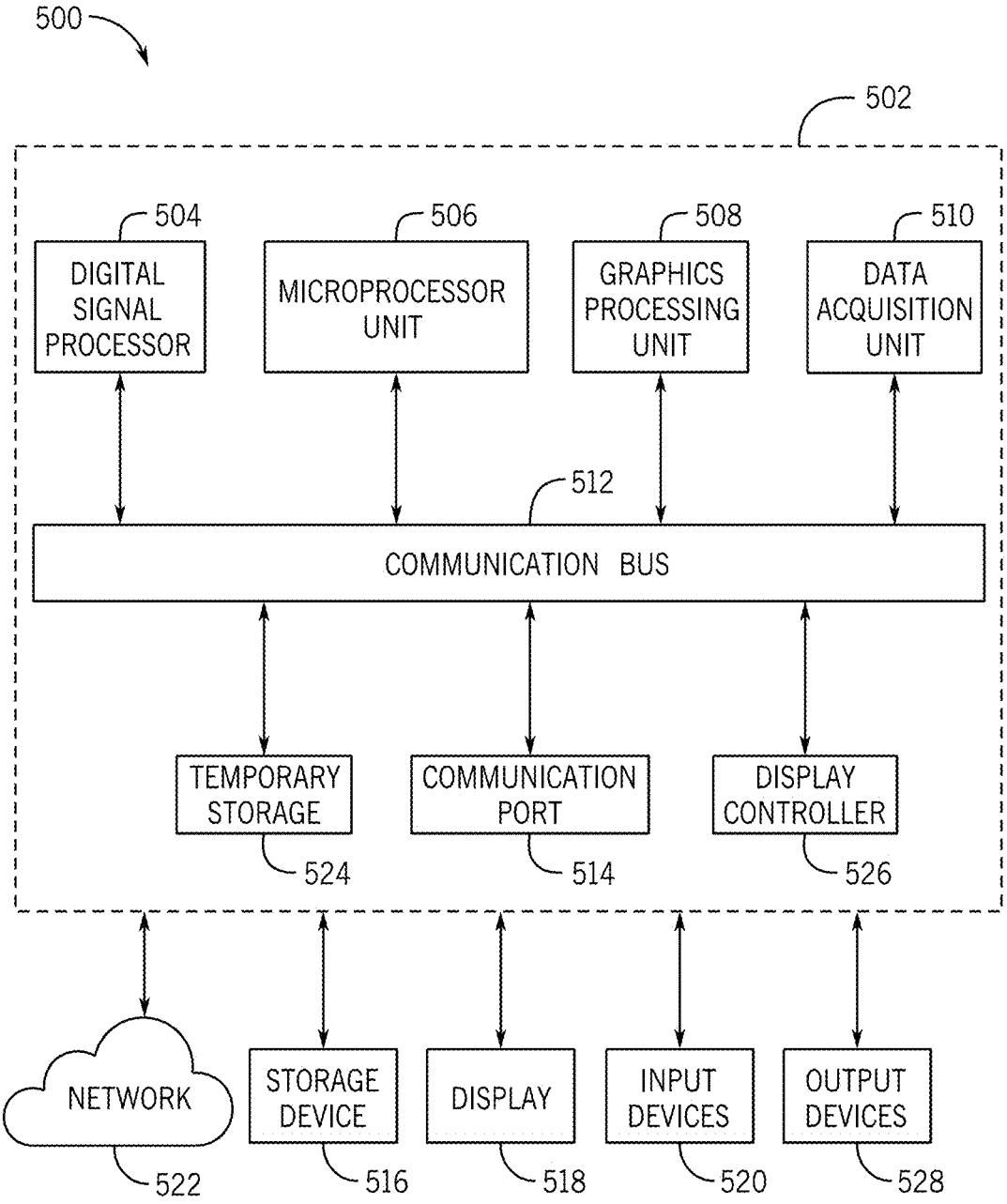
FIG. 5 is a block diagram of an example controller in accordance with an embodiment.

The controller 310 may comprise any suitable computer system. FIG. 5 is a block diagram of an example computer system in accordance with some embodiments. Computer system 500 may be used to implement the systems and methods described herein. In some embodiments, the computer system 500 may be a workstation, a notebook computer, a tablet device, a mobile device, a cell phone, a smartwatch, a multimedia device, a network server, a mainframe, one or more controllers, one or more microcontrollers, or any other general-purpose or application-specific computing device. The computer system 500 may operate autonomously or semi-autonomously, may read executable software instructions from the memory or storage device 516 or a computer-readable medium (e.g., a hard drive, a CD-ROM, flash memory), or may receive instructions via the input device 520 from a user, via the network 522, or any other source logically connected to a computer or device, such as another networked computer or server. Thus, in some embodiments, the computer system 500 can also include any suitable device for reading computer-readable storage media.

Data, such as data acquired by one or more configurable training devices 100, for example data from one or more sensors 110 or cameras 116, may be provided to the computer system 500 directly from the one or more configurable training devices 100 or from a data storage device 516, and these data may be received in a processing unit 502. In some embodiments, the processing unit 502 includes one or more processors. For example, the processing unit 502 may include one or more of a digital signal processor (DSP) 504, a microprocessor unit (MPU) 506, and/or a graphics processing unit (GPU) 508. The processing unit 502 may also include a data acquisition unit 510 that is configured to electronically receive data to be processed. The DSP 504, MPU 506, GPU 508, and data acquisition unit 510 may be coupled to a communication bus 512. The communication bus 512 may comprise, for example, a group of wires, routing on a semiconductor die, hardware used for switching data between the peripherals or between any components in the processing unit 502, and the like.

The processing unit 502 may also include a communication port 514 in electronic communication with other devices, which may include a storage device 516, a display 518, one or more output devices 528, and one or more input devices 520. Examples of an input device 520 include, but are not limited to, a configurable training device 100 (e.g., sensor 110, camera 116), a keyboard, a mouse, a touch screen through which a user can provide an input, a touch sensitive interface, one or more physical buttons, or the like. An example of an output device 528 includes, but is not limited to, a configurable training device 100 (e.g., indicator 106). The storage device 516 may be configured to store data, which may include data related to an athletic training session, such as, for example, number of attempts, number of hits, number of misses, impact locations, reaction speed, accuracy, training session duration, statistics over a plurality of training sessions, other relevant statistical data, body position information, object detection information, and the like, whether these data are provided to, retrieved by, or processed by, the processing unit 502. The display 518 may be used to display images and other information, such as accuracy, speed, other statistical data, encouragement, score, suggestions, and the like.

The processing unit 502 can also be in electronic communication with a network 522, for example wired or wirelessly, to transmit and receive data and other information. The communication port 514 can also be coupled to the processing unit 502 through a switched central resource, for example the communication bus 512. The processing unit can also include temporary storage 524 and a display controller 526. The temporary storage 524 may be configured to temporarily store information. For example, the temporary storage 524 can be a random access memory.

The memories described herein may be of any suitable type, such as volatile or nonvolatile, local or remote (cloud, networked, etc.), and may comprise multiple memories of any suitable combination. The memory may be configured to be large enough to store relevant information, such as the data described above, and/or program code configured to perform the methods described herein.

Computer-executable instructions for athletic training sessions, body position estimation, impact detection, indicator control, sensor analysis, and the like according to the methods described herein may be stored on a form of computer readable media. Computer readable media includes volatile and nonvolatile, removable, and non-removable media implemented in any method or technology for storage of information such as computer readable instructions, data structures, program modules or other data. Computer readable media includes, but is not limited to, random access memory (RAM), read-only memory (ROM), electrically erasable programmable ROM (EEPROM), flash memory or other memory technology, compact disk ROM (CD-ROM), digital volatile disks (DVD) or other optical storage, magnetic cassettes, magnetic tape, magnetic disk storage or other magnetic storage devices, or any other medium which can be used to store the desired instructions and which may be accessed by a system (e.g., a computer), including by internet or other computer network form of access.

Figure 6:
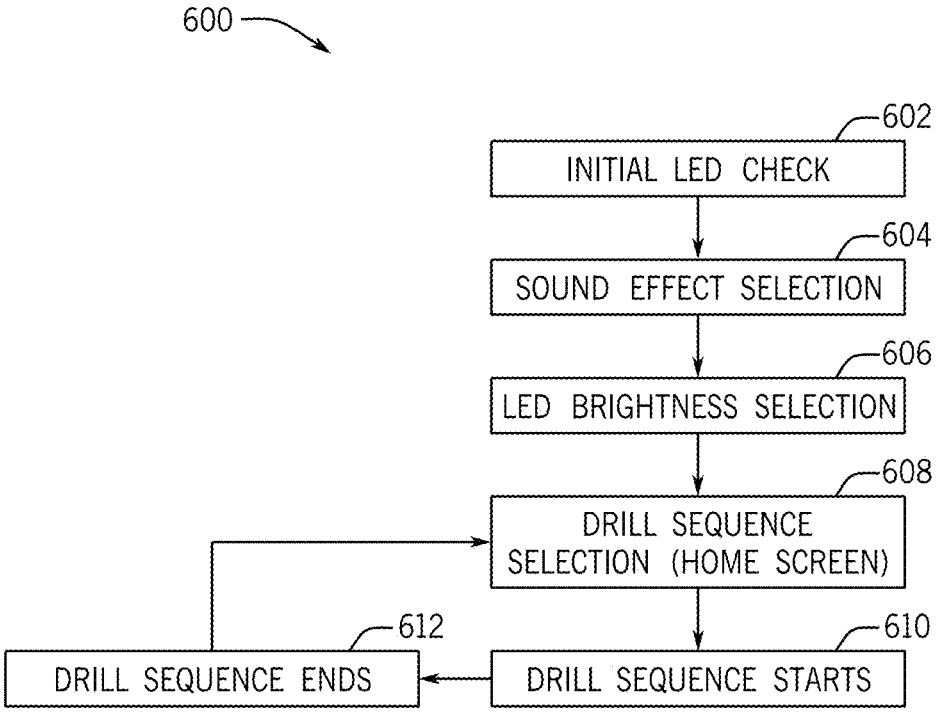
FIG. 6 illustrates a method for initiating a drill sequence.

As discussed above, the configurable training system 300 may be configured for use with or as athletic training equipment or other recreational games. FIG. 6 illustrates a method 600 for initiating the configurable training system 300 in accordance with some embodiments. When powered on, reset, or otherwise initialized, the configurable training system 300 may perform a check of the indicators 106, for example one or more LEDs. In some embodiments, the individual LEDs on one or more configurable training devices 100 may be lit up sequentially, for example over a time period of a few seconds.

The method 600 may then proceed to a sound selection step 604, an indicator selection step 606, and a drill sequence selection step 608. In some embodiments, the one or more configurable training devices 100 may be configured to accept a touch input (e.g., detected by sensor 110), voice input, input from a mobile device, or other input as a selection mechanism, and may be configured to provide an indication of the selection options (e.g., using the indicator 106). In some embodiments, the controller 310 may be configured to accept a user input other than a direct touch input, for example via a software application when controller 310 comprises a user device such as a smartphone, smartwatch, tablet, other mobile device, laptop, computer or other device having suitable computational power and connectivity. In some embodiments, the controller 310 may be configured to accept a user input via a communicatively coupled user device such as a smartphone or tablet, which may be running a software application configured to communicate with the controller 310.

In some embodiments, during the sound selection step 604, the configurable training system 300 may cause a first configurable training device 100 to display a first color light (e.g., a red light) and a second configurable training device 100 to display a second color light (e.g., a green light). If the configurable training system 300 detects a touch input on or near the first configurable training device 100 (or another suitable user input), then the configurable training system 300 may disable (e.g., mute) sound output. If the configurable training system 300 detects a touch input on or near the second configurable training device 100 (or another suitable user input), then the configurable training system 300 may enable sound output. Sounds may be played, for example, when an impact is detected, when a goal is reached, at the start and end of a training sequence, or the like. After detecting a touch input on or near the second configurable training device 100, then the method 600 may move to a next step.

In some embodiments, during the indicator selection step 606, the configurable training systems 300 may cause a first configurable training device 100 to display a first color light (e.g., a white light) at a first brightness level, and a second configurable training device 100 to display a second color light (e.g., a green light). If the configurable training system 300 detects a touch input on or near the first configurable training device 100 (or another suitable user input), then the configurable training system 300 may increase or decrease the brightness level (in any suitable increments, e.g., steps of 10% brightness) with each touch input detected. In some embodiments, after reaching 100% or 0% brightness, the brightness level may loop around to the other end of the brightness scale (e.g., 80%→90%→100%→10%). If the configurable training system 300 detects a touch input on or near the second configurable training device 100 (or another suitable user input), then the configurable training system 300 may select or save the current brightness level as the brightness level for the indicators 106. A lower brightness level may be preferable for indoor use, while a higher brightness may be preferable for outdoor use. After detecting a touch input on or near the second configurable training device 100, then the method 600 may move to a next step.

In some embodiments, during the drill sequence selection step 608, the configurable training system 300 may cause a first configurable training device 100 to display a first color light (e.g., a yellow light) at an initial drill sequence selection step, and a second configurable training device 100 to display a second color light indicating one or more battery levels of the configurable training system 300. For example, the second configurable training device 100 may display a green light for a battery level between about 21% and 100%, and a red light for a battery level between 0% and about 20%. In some embodiments, if the configurable training system 300 detects a touch input on or near the first configurable training device 100 (or another suitable user input), then the configurable training system 300 may advance to a subsequent drill selection step, and may cause the first configurable training device 100 to display a first color light and/or number of lights indicating the currently-selected drill sequence, and the second configurable training device 100 to display a second color light (e.g., a green light).

In some embodiments, in the subsequent drill selection step, if the configurable training system 300 then detects a touch input on or near the first configurable training device 100 (or another suitable user input), then the configurable training system 300 may change the drill sequence selection, which may comprise any suitable order of progressing through all available drill sequences. In some embodiments, the configurable training system 300 may cause the first configurable training device 100 to display an increasing number of lights as the drill sequence selection changes, and/or to display the drill sequence number on a display. In some embodiments, the configurable training system 300 may cause the first configurable training device 100 to display a varying color of lights as the drill sequence selection changes (e.g., progressing from green through red for easy through hard drill sequences). If the configurable training system 300 detects a touch input on or near the second configurable training device 100 (or another suitable user input), then the configurable training system 300 may select, save, or otherwise proceed with the currently-selected drill sequence. The configurable training system 300 may then start the drill sequence 610, and once the drill sequence is complete 612 it may return to the drill sequence selection step 608, may determine whether to stop the method 600, and/or otherwise check if the user wishes to continue or stop.

A drill sequence may comprise one or more steps performed by the controller 310 to indicate to a user and/or detect user interaction using one or more configurable training devices 100. Thus, as used herein, a drill sequence may refer to a sequence of indications and observing user interactions, for example for athletic training, games, entertainment, and the like.

In an exemplary embodiment, the configurable training system 300 may comprise a plurality of configurable training devices 100 configured at targets (e.g., each comprise a sensor 110 and indicator 106, such as configurable training devices 100*a* referring to FIG. 4B) and a plurality of configurable training devices 100 configured as direction guides (e.g., each comprise an indicator/sensor 110, such as configurable training devices 100*b* referring to FIG. 4B). The direction guides may, for example, indicate to the user which foot to use to kick a soccer ball at the target, a direction to turn before passing the ball to the target, or the like.

A first beginner drill sequence may comprise indicating only one of the targets, for example activating the indicator 106, and detecting an impact at said target. A second beginner drill sequence may comprise indicating and detecting a first target, and then indicating and detecting a second target, and repeating these steps. A third beginner drill sequence may comprise randomly indicating and detecting a target. Such sequences described herein may include repeating the indicating and detecting steps until the user indicates to end, for a fixed number of times, for a random number of times, or the like.

A first intermediate drill sequence may comprise indicating and detecting only one of the targets, while regularly alternating which direction guide is active, and detecting an impact at said target. A second intermediate drill sequence may comprise alternating between indicating and detecting a first target and second target, while activating a random direction guide. A third intermediate drill sequence may comprise randomly indicating and detecting a target while activating a random direction.

A first advanced drill sequence may comprise indicating and detecting only one of the targets, while activating a random direction guide with one of two different colors. The different colors may, for example, indicate different reactions to be taken by the user, for example a soft or hard shot at the target. A second advanced drill sequence may comprise alternating between indicating and detecting a first target and second target, while activating a random direction guide with one of two different colors. A third advanced drill sequence may comprise randomly indicating and detecting a target while activating a random direction with one of two different colors.

A first professional drill sequence may comprise indicating and detecting only one of the targets, while activating a random direction guide with one of four different colors. The different colors may, for example, indicate different reactions to be taken by the user. In some embodiments, for example, the colors may indicate a cone of the selected color which the user must dribble around. For example, if the direction guide displays red, the user must dribble around the cone also displaying red and return to the home position before proceeding. In some embodiments, the colors may indicate a mini-goal into which the user is to pass a ball. The direction guides allow reaction training to increase the user's speed of play, both mentally and technically. A second professional drill sequence may comprise alternating between indicating and detecting a first target and second target, while activating a random direction guide with one of four different colors. A third professional drill sequence may comprise randomly indicating and detecting a target while activating a random direction with one of four different colors. In these and other embodiments, the direction guides may facilitate reaction training to increase the user's speed of play, both mentally and technically.

Figure 7:
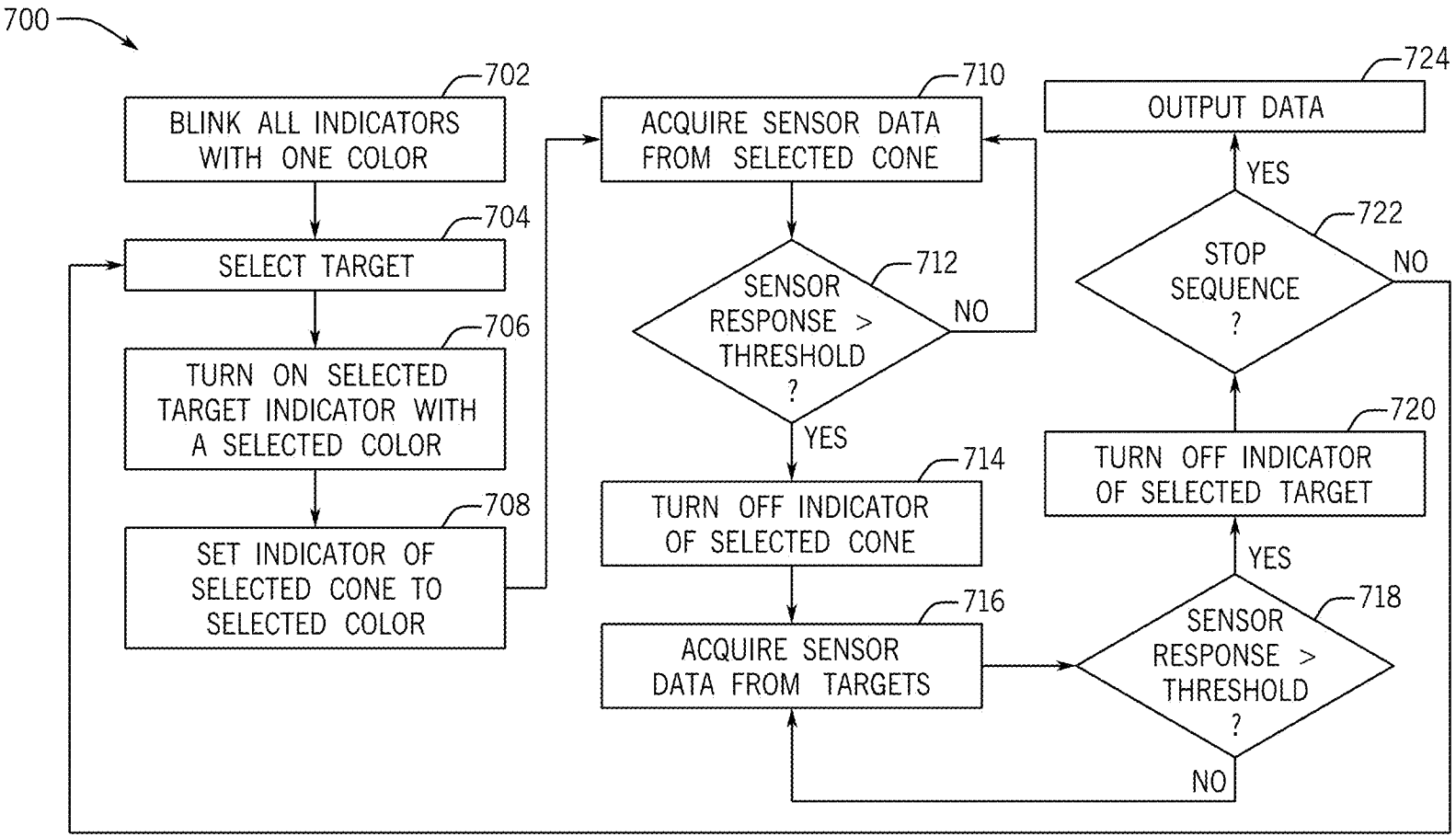
FIG. 7 illustrates a method for a drill sequence.

Referring to FIG. 7, an exemplary embodiment of an agility-focused drill sequence is shown. For this embodiment, the configurable training system 300 may comprise a plurality of configurable training devices 100 configured as drill cones, and a plurality of configurable training devices 100 configured as kickback wall targets. Each configurable training device may comprise an indicator 106 comprising a light, and a sensor 110 to detect an impact. A user may indicate to the controller, for example via a software application communicatively coupled with the controller 310 (e.g., software application on a user device, where controller 310 comprises the user device or a separate controller communicatively coupled with the user device), the arrangement and configuration of the configurable training devices. For example, the user may define, using the software application, how many configurable training devices 100 are deployed as cones and how many configurable training devices 100 are deployed as targets. In some embodiments, the controller 310 may communicate with each configurable training device to determine deployment details such as location, orientation, configuration, and the like.

When the drill sequence 700 begins, the controller may blink all indicators 106 in the configurable training system 300 a certain color. This may indicate to the user, for example, a time period for warm-up. The controller 310 may then select a target (e.g., at step 704), such as a sensor unit 100, for the user to hit, for example with a soccer ball. The selection may be done in any suitable manner, such as sequential through all targets or randomly selected. The controller 310 may then turn on the indicator 106 of the selected target with a selected color 706. The color may be selected in any suitable manner, such as from a predefined set of colors or randomly selected. The controller 310 may then select a cone (randomly or otherwise) and turn on its indicator 106 with the selected color 708. This may, for example, indicate to the user that they are to run and touch the cone having the selected color, or to contact the sensor with a ball, or to dribble a ball around the cone. A mobile app associated with the system 300 or an audible instruction (e.g., from a speaker of the system 300) may instruct a user how to respond to the given lighting/colors of the cones according to the sport or activity for which training is to be provided.

At step 710, the controller 310 acquires data from the sensor 110 of the selected cone, and then determines if the sensor data indicates an impact above a predefined threshold 712. The controller 310 may continue acquiring sensor data until it detects an impact above the threshold. Upon detecting an impact above the threshold 712, for example when the user sufficiently touches the cone, the controller 310 may then turn off the indicator 106 of the selected cone 714. After touching the selected cone, the user may then run and touch the selected target on the kickback wall, may kick a soccer ball at the selected target, and so on. The controller 310 may then acquire data 716 from the sensors 110 of the targets.

In some embodiments, the sensor 110 may be a piezo sensor, which generates electric energy (voltage) in response to mechanical force (touch/impact/vibration). Piezo sensors may also comprise varying degrees of sensitivity, and varying ranges of detectable changes in force (e.g., some very sensitive piezo sensors may "max out" and not discern a difference between two different, but very forceful impacts or vibrations), while others may be adjustable. Other sensors, such as strain gauge sensors, accelerometers, pneumatic or hydraulic load cells, inductive load cells, force-sensing resistors, and the like are possible, as well as others that measure compression, bending, shear, and similar forces. In some embodiments, the controller 310 can continuously read analog signals from the voltage outputs of the piezo sensors, or the signals can be converted to digital via analog-to-digital circuitry at the sensor, then communicated to the controller 310 through a number of wired or wireless protocols, such as Bluetooth®, a local Wi-Fi connection, Z-Wave®, Zigbee®, or other similar connection. In some embodiments, signals from the sensors 110 may be sent on a periodic basis (such as at a set number of "reads" per second) or only when the sensors output a signal above a certain threshold, or may go into a "sleep" mode if no above-threshold sensor outputs are detected for a given period of time. In further embodiments, the sensors may comprise internal controllers that adjust sensing output according to battery life in order to preserve the battery.

Generally, unless the sensors 110 have any contact/touch or impact, the output signals from the sensors are considered to be zero. If there is any contact/touch with the sensor or kickback wall (in embodiments in which the sensors are removably or fixedly attached to the kickback wall) the output signal of the piezo sensors becomes greater than zero. To eliminate some detection errors, an initial "read" threshold value can be set for the sensor output. In one embodiment, a piezo sensor was used which has an output that can range from 0 to 1023 (based on analog detection capabilities of the controller), and the initial read output threshold was set to 5. If the microcontroller detects the piezo signal outputs greater than the threshold value of 5, the microcontroller continues to collect the piezo sensor outputs and sums up the individual sensor outputs over a period of time (e.g., until 35 signal data collection cycles). If one of the piezo sensor outputs is greater than 80 (this threshold setting can be adjusted as necessary given the types of sensors, sport/use of the device, etc.), the microcontroller considers the sensor or kickback wall to be hit by an object such as a soccer ball, hand, or foot. The threshold "impact detection" setting (a value of 80) is based on the power of the ball impact. So, in some examples, the more power a typical soccer player uses to practice passing and shooting, the higher the value to which the impact detection threshold setting can be adjusted. In some embodiments, this setting may be adjusted by a user (e.g., through a mobile app, a dial, lever, etc. associated with the controller 310). Lastly, if the piezo sensor output of a selected target 100*a* is 60% greater than the total output signal of all sensors (e.g., two other piezo sensors, for example in other targets 100*a*), the kickback wall system may consider the selected target 100*a* to be hit by the ball successfully. On contrary, if the piezo sensor output of the selected target 100*a* is less than 60% of the total output signal of all sensors (e.g., two other piezo sensors, for example in other targets 100*a*), the system considers the ball to have missed the selected target 100*a* and turns on the other target 100*a* indicators to a red color. The hit threshold setting for the selected target 100*a* is set to 60% in order not to break the rhythm of ball pass practice. However, as more accurate target hitting practice is required, a higher value of hit threshold setting should be considered. Likewise, a lower value threshold may be set as desired, for example to make a drill easier.

In some embodiments, as described above, multiple threshold settings may be applied so users can, for example, effectively practice passing and shooting drills using a plurality of targets 100*a*. In some embodiments, when the target 100*a* is set up as an isolated sensor (e.g., configured as a cone and not part of the same substrate as other sensors such as a kickback wall), a single threshold setting may be sufficient to detect a touch, hit, etc. Thus, in such embodiments, the material requirements may be more relaxed. For example, a drill cone 230 may not be required to be made from metal, high-density plastic, or the like.

In some embodiments, the configurable training system 300 may determine the speed of an object that impacts the athletic training equipment with which it is deployed. For example, for a kickback wall 410 having a plurality of targets 100*a*, the controller 310 may determine the speed of impact based on a fixed location from the kickback wall 410 (e.g., five feet from the kickback wall 410) at which the user is intended to stand and the time between the determined hits of the plurality of targets 100*a*. In some embodiments, the magnitude (absolute or relative) of the sensor 110 outputs may be used to determine impact speed. In some embodiments, the targets 100*a* may comprise a camera 116, and the controller may determine impact speed based on determining the impact object location in a plurality of image frames. For example, in some embodiments, the controller 310 may determine the pixel size of the object (e.g., ball) in the image frame over a plurality of frames, and based on the time between frames and change in size of the object, may calculate a speed of the object. In some embodiments, the controller 310 may determine a distance of the object based on the pixel size of the object in the frame. In some embodiments, the camera 116 may facilitate depth sensing as a time-of-flight image sensor, stereoscopic camera, or the like.

The controller 310 may then determine 718, based on the sensor data, which target was most-closely impacted, and if the sensor data indicates an impact above a predefined threshold (which may be the same or different from the predefined threshold for the cones). If the selected target was not most closely impacted (e.g., the impact of the soccer ball was off-target), or was hit with insufficient impact, then the controller 310 may continue acquiring data 716 from the sensors 110 of the targets. Upon detecting that the selected target was the most-closely impacted target and was sufficiently impacted, the controller 310 may turn off the indicator of the selected target 720.

The controller 310 may then determine if the drill sequence should terminate 722. In some embodiments, this determination may be automatic (e.g., after a certain number of repetitions). In some embodiments, the determination to terminate 722 may be requested from the user, for example via the software application. If the controller 310 does not receive an indication to terminate the drill sequence, then the controller 310 may repeat the drill sequence starting at step 704. If the controller 310 receives an indication to terminate the drill sequence, it may then output data 724 from the drill sequence session.

Outputting data 724 from the drill sequence session may comprise storing, displaying, or otherwise communicating information acquired and determined by the controller 310 during the course of one or a plurality of drill sequences. For example, data may be stored in storage device 516, transmitted to the user, for example via network 522 to a user device for display and/or storage, displayed on a display of the configurable training system 300, or the like. Data from the drill sequence session(s) may comprise, for example, number of attempts, number of hits, number of misses, impact locations, reaction speed, accuracy, training session duration, statistics over a plurality of training sessions, other relevant statistical data, body position information, object detection information, or the like.

Example 1

In one implementation, a training system may be provided which comprises at least two sensors housed in sensor units (which may, for example, be sensors 110 as shown in FIGS. 1A and 1B or other suitable sensors as described here) and a wall unit. The sensors may be connected to a controller either via a wired or wireless connection. The controller may be housed within a control unit connected to the wall unit or may be provided via a mobile app on a user's mobile device (and the sensors connect to the device via a wireless connection). The wall unit may comprise a number of directional and/or colored lights, a camera, and/or a speaker to provide guidance to the user. The wall unit may also include a kickback face panel with openings to receive the sensor units. In addition, the wall unit may comprise a number of panels or other sub-components which are shaped and sized such that the wall unit can be disassembled and reassembled into different configurations for different drills and/or different sports. For example, the wall unit may include a kickback face panel, side panels, and a friction panel, which can optionally be disconnected from one another and reconnected in a different configuration for, e.g., tennis instruction or basketball instruction (which may benefit from the sensors being higher off the ground (e.g., starting from a soccer configuration as described above, the friction plate can take the place of the kickback panel, then the kickback panel can be connected on top of and in a plane with the friction plate so that it is higher off the ground). It is contemplated herein that the panels of the wall unit may be designed to have suitable tabs and slots to allow for their reconfiguration into a number of suitable structures adaptable for providing different drills (high kicking/passing/shooting, low kicking/passing/shooting, etc.).

Example 2

In a further example, a smart athletic drill system may be provided which comprises a set of at least two sensors, such as the sensors of FIGS. 1A and 1B or as otherwise described above. The sensors may include a housing that is configured to be connected to a number of housings, including a kickback panel, cones, hook/clip housings, or the like, so as to allow the sensors to be utilized in a variety of applications. In some embodiments the housings of the sensors comprise rings, tabs, slots, magnetic surfaces, clasps, or other physical connectors for removable connection of the sensors to such accessories/housings. These connectors may also include sensors, such as electrical contactors, from which the sensors can detect the type of housing or accessory to which they are connected. For example, upon connection of a sensor to a kickback wall, a first contactor may cause an electrical connection to be made to indicate to the sensor that it is attached to a kickback wall, and upon connection of the sensor to a hook/clip housing a second contactor may cause an electrical connection to be made to indicate to the sensor that it is attached to a hook/clip housing. The sensor can include circuitry or a processor that provides these indications to a controller (whether wirelessly to a mobile device or other controller, or by wired connection). Based upon these indications, the controller can adjust various thresholds or similar settings to ensure that detections of "hits" and "misses" properly correspond to the differences in sensor outputs. For example, when a sensor is situated in a hook/clasp housing, it may not be as stable as a sensor attached to a kickback panel. When in a hook/clasp housing, the sensor might be hanging from a rod or clipped to a net (e.g., of a soccer goal) such that it might sway or swing—the controller can take these motions into account and correspondingly increase the "read" and "hit" thresholds, and can adaptively apply logic to ignore sensor output caused by a sensor swaying back and forth after an impact (e.g., after a peak sensor output, intelligently discarding rhythmic sensor outputs or similar sensor outputs indicative of after-impact motion). Alternatively, when a sensor detects that a contactor makes an electrical connection indicative of being connected to a kick panel, for which the chances of after-impact sway are low, the controller can process sensor output more sensitively, to capture more sensor outputs as potentially being "hits." In yet other embodiments, users may indicate via a mobile app or other software the configuration in which they intend to use the sensors, and such selection can then be communicated to the sensors' controller to cause an appropriate change in how sensor output is processed. The mobile app or software can also allow a user to select which product line is being used, which sport, how many sensors are being used, how each sensor is deployed (e.g., in a cone, clip housing, kickback wall, etc.), etc., and based on such selections the app or software can present suitable drills to choose.

In embodiments comprising sets of sensors, various colored lights may be integrated into the sensor units themselves, to provide directional, target, and other indications to users as described above. Thus, the sensors can be configured to be adaptable both in how they are positioned as well as in how their output is processed relative to their positioning.

Example 3

In other examples, systems employing the components provided herein can gather data concerning performance on drills (e.g., corresponding with a user profile), to monitor progress, adjust drill difficulty, and suggest more advanced drills as a user progresses. For example, a system could monitor a player's progression on certain drills, and prescribe more drills for the user complementary to the drills for which the player has not made adequate progress. Other attributes of the player could be monitored, such as player reaction times (e.g., based on time from directional light indications to confirmation of the player's corresponding activity, such as ball impact). Similarly, overall drill speed could also be tracked, from initiation of the drill (e.g., a green indicator light or a sound) until the final target is hit. And, in further embodiments, the system could track improvements in ball force/speed upon striking a sensor. In some embodiments, the sensors may be disposed within a kickback wall or other housing containing a camera and/or other sensors. In some embodiments, the camera may be an optical camera, and in other embodiments the camera may be stereoscopic, infrared, or otherwise provide depth information in addition to or instead of an optical camera. Then sensors, in combination with the camera, can provide information regarding ball speed and impact force. In some embodiments, the cameras may track ball movement, and can derive speed from changes in the size (by pixels) of the ball as it approaches the camera as a function of time (e.g., periodicity of image acquisition of the camera. In other embodiments, speed can be derived by the system by interpreting a player's distance from the camera (using depth information), and the time from the player's strike of a ball until impact. In other embodiments, a more classic speed sensor, such as lidar or radar-based could be utilized.

In further embodiments, data concerning a player's performance (in accordance with applicable privacy laws) can be shared. In one embodiment, a player may choose to upload data regarding their performance to social media or a website associated with the maker of the training system. In other embodiments, a player may choose to send data regarding his/her performance to a coach or other third party. The player's coach could review the data and prescribe additional drills for the player, which could be presented via a mobile app or other software to the user to be initiated in the training system.

In other embodiments, logic, software, or artificial intelligence associated with the controller can provide in-training feedback to a player, such as via a speaker, screen, or indicator lights (including the same from an app or software of a mobile device, or as may be integrated into a kickback unit). In such examples, a target accuracy requirement (such as a sensor sensitivity or "hit" threshold of a controller) can be adaptively changed to correspond to a user's ability. Or, the difficulty of a drill can be increased or decreased based upon a user's target accuracy, time of drill completion, etc., such as by increasing or decreasing the number of cones around which a player might dribble a ball, or side-to-side movement indications, etc. In some embodiments, the controller may comprise software that causes it to present tips or motivational messages to a user based upon detected user activity, whether via a speaker, screen, mobile device, or the like. Examples may include: messages indicating good or bad target accuracy, improvement or regression on drill times based on previous sets, random motivation, coaching tips, end of session summary, and coaching informational messages based on level of player. A mobile app or other software may also include an augmented reality function, which supports correct placement of cones, equipment, and other accessories for various drills.

It will be appreciated by those skilled in the art that while the disclosed subject matter has been described above in connection with particular embodiments and examples, the present disclosure and the claims of the present disclosure are not necessarily so limited, and that numerous other embodiments, examples, uses, modifications and departures from the embodiments, examples and uses are intended to be encompassed by the claims attached hereto. The entire disclosure of each patent and publication cited herein is hereby incorporated by reference, as if each such patent or publication were individually incorporated by reference herein.

Various features and advantages of the various aspects presented in the present disclosure are set forth in the following claims.

The invention claimed is:

1. A configurable training device, comprising:

a housing;

a front cover coupled to a front surface of the housing;

a sensor located within the housing, separated from the front cover by an indicator, and configured to detect an impact made on the housing;

wherein the indicator is located within the housing, wherein the indicator is configured to emit visible light having a color and a brightness level that varies in multiple incremental steps in a chosen direction towards a first end of an available range of brightness with each external input representing activity in which the configurable training device is involved to convey information about said activity to a user of the device; and communication circuitry coupled with the indicator and the sensor.

2. The configurable training device of claim 1, wherein the sensor comprises a piezo sensor.

3. The configurable training device of claim 1, wherein the indicator comprises a plurality of light-emitting diodes (LEDs) arranged in a shape of a ring.

4. The configurable training device of claim 1, wherein the indicator is configured to re-set a multi-step incremental variation of the brightness level of the visible light with said each external input in the chosen direction at a second end of the available range of brightness once the first end has been reached.

5. The configurable training device of claim 1, wherein the housing is configured to couple with an adaptor.

6. The configurable training device of claim 5, wherein the adaptor comprises a cone adaptor.

7. The configurable training device of claim 5, wherein the adaptor is configured to couple with a kickback wall.

8. The configurable training device of claim 5, wherein the housing comprises an extension configured to accept at least one of a screw or a bolt.

9. The configurable training device of claim 8, wherein the adaptor is configured to accept at least one of a screw or a bolt.

10. A configurable training system, comprising:

at least one configurable training device that comprises:

an indicator; and communication circuitry coupled with the indicator; and a controller communicatively coupled with the at least one configurable training device via the communication circuitry, wherein the controller is configured to perform a sequence of drill activities and to turn on the indicator to emit light with a color indicative of said sequence and to vary a brightness level of the light emitted by the indicator of the at least one configurable training device in multiple incremental steps in a chosen direction towards a first end of an available range of brightness with each external input representing activity in which the at least one configurable training device is involved to convey information about said activity to a user of the device.

11. The configurable training system of claim 10, wherein the configurable training system comprises a plurality of configurable training devices each including a corresponding indicator and communicatively coupled with the controller.

12. The configurable training system of claim 11, wherein the configurable training system comprises:

a first direction guide comprising a first configurable training device of the plurality of the configurable training devices; and a first target comprising a second configurable training device of the plurality of the configurable training devices, wherein the second configurable training device comprises a first impact sensor coupled with communication circuitry of the second configurable training device.

13. The configurable training system of claim 12, wherein the controller is configured to perform the sequence of drill activities using the first direction guide and the first target.

14. The configurable training system of claim 12, wherein the first impact sensor comprises a piezo sensor.

15. The configurable training system of claim 10, wherein the indicator comprises a plurality of LEDs arranged in a shape of a ring.

16. The configurable training system of claim 10, wherein the controller is configured to re-set a multi-step incremental variation of the brightness level of the visible light of the indicator at a second end of the available range of brightness once the first end has been reached.

17. The configurable training device of claim 10, wherein the configurable training device is configured to couple with an adaptor.

18. The configurable training device of claim 17, wherein the adaptor comprises a cone adaptor.

19. The configurable training device of claim 17, wherein the adaptor is configured to couple with a kickback wall.

20. The configurable training system of claim 12, wherein the configurable training system further comprises:

a second target comprising a third configurable training device of the plurality of the configurable training devices, wherein the third configurable training device comprises a second impact sensor coupled with communication circuitry of the third configurable training device, and wherein:

the first direction guide and first target are configured to couple with a kickback wall; and the second target is configured to couple with a cone adaptor.

* * * * *